US007021188B1

(12) United States Patent
Berkovich et al.

(10) Patent No.: US 7,021,188 B1
(45) Date of Patent: Apr. 4, 2006

(54) GRENADE LAUNCHER WITH ENHANCED TARGET FOLLOW-UP

(75) Inventors: Eyal Berkovich, Haifa (IL); Shimon Chachamian, Haifa (IL)

(73) Assignee: RAFAEL–Armament Development Authority Ltd., Haifa (IL)

( * ) Notice: Subject to any disclaimer, the term of this patent is extended or adjusted under 35 U.S.C. 154(b) by 455 days.

(21) Appl. No.: 10/679,329

(22) Filed: Oct. 7, 2003

(51) Int. Cl.
*F41G 3/02* (2006.01)
*F41G 3/06* (2006.01)

(52) U.S. Cl. ..... 89/41.17; 89/41.06

(58) Field of Classification Search ..... 89/41.17, 89/41.15, 41.06
See application file for complete search history.

(56) References Cited

U.S. PATENT DOCUMENTS 5,686,690 A * 11/1997 Lougheed et al. ..... 89/41.17
6,460,447 B1 * 10/2002 Meyers et al. ..... 89/41.06
6,499,382 B1 * 12/2002 Lougheed et al. ..... 89/41.05

FOREIGN PATENT DOCUMENTS

CA 0505357 * 8/1954 ..... 89/41.17

* cited by examiner

*Primary Examiner*—Stephen M. Johnson
(74) *Attorney, Agent, or Firm*—Welsh & Flaxman LLC

(57) ABSTRACT

A system for enhancing targets follow-up by a gunner of an automatic grenade launcher (AGL). After aiming the sight at the target and measuring range to it, the liner lock fixing the sight to the cradle mount is disengaged. The AGL is subsequently free to accept a superelevation inclination angle while the sight remains aligned with the target. Simultaneously, the sight is fixed vertically to the system mount by a temporary engagement of a mount-brake. The AGL elevation angle is applied by motor automatically as a function of the said measured range.

5 Claims, 6 Drawing Sheets

GRENADE LAUNCHER WITH ENHANCED TARGET FOLLOW-UP

FIELD OF THE INVENTION

The present invention relates generally to heavy machine gun firing control systems. More specifically the present invention deals with firing control of automatic grenade launchers.

BACKGROUND OF THE INVENTION

In order to deliver heavy ammunition to the target, the machine gun, such as an automatic grenade launcher, (AGL), is inclined in an angle steeper than the straight line connecting between the sight and the target. The straight line connecting between the gunner using the gun-sight and the target is the line of sight to the target. For a given amount of thrust power, the heavier the ammunition is, the higher the gun has to be raised in order to deliver the ammunition to the target. If the gun-sight is set parallel to the gun, the high elevation may be distracting to the gunner in that the he may lose eye contact with the target or may even end up looking in the empty sky. This is described in FIGS. 1A–C to which reference is now made. In the configuration of FIG. 1A, a gun is composed of a body 16 and a barrel 18. The gun can be rotated vertically around a horizontal axis of the mount 20, in the direction indicated by arrow 22. In this configuration, sight 24 is looking in a parallel direction to the gun-barrel 18. In the configuration of FIG. 1B, the barrel 18 and sight 24 are aligned in parallel, pointing at a target, not shown. A straight dashed line 30 represents the line of sight connecting sight, and the gunner, with the target. This line of sight forms an angle a with a horizontal reference line 32, which in this configuration coincides with the horizontal plane of the mount 20 of the gun. In the configuration of FIG. 1C, the gun has rotated upwards to angle β with respect to line 30. The new angle of inclination is the calculated angle which is required to get the ammunition to the target, by evoking the appropriate trajectory for the ammunition. In this configuration, sight 24 is pointing at the same angle above the horizon as the gun. The angle of the gun relative to the horizon is the angle of super-elevation, and is a function of the distance and position of the target and the ammunition type. The super elevation reflects on the ability of the gunner to manage target follow-up as explained above.

DETAILED DESCRIPTION OF THE PRESENT INVENTION

Figure 1A:
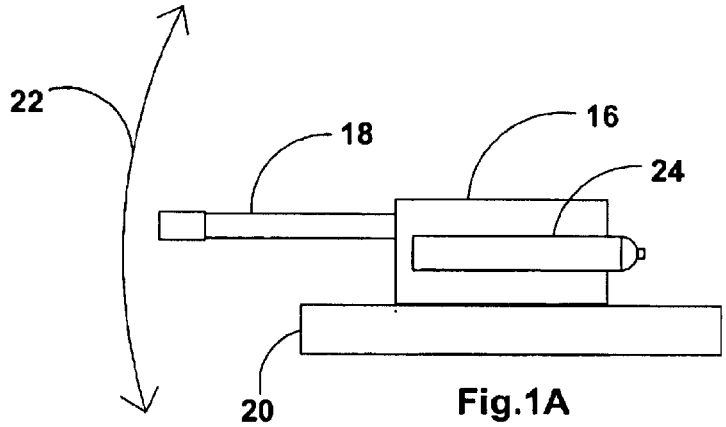
FIG. 1A is a schematic description of a configuration of a gun and a gun-sight aligned in parallel, horizontally.
Figure 1B:
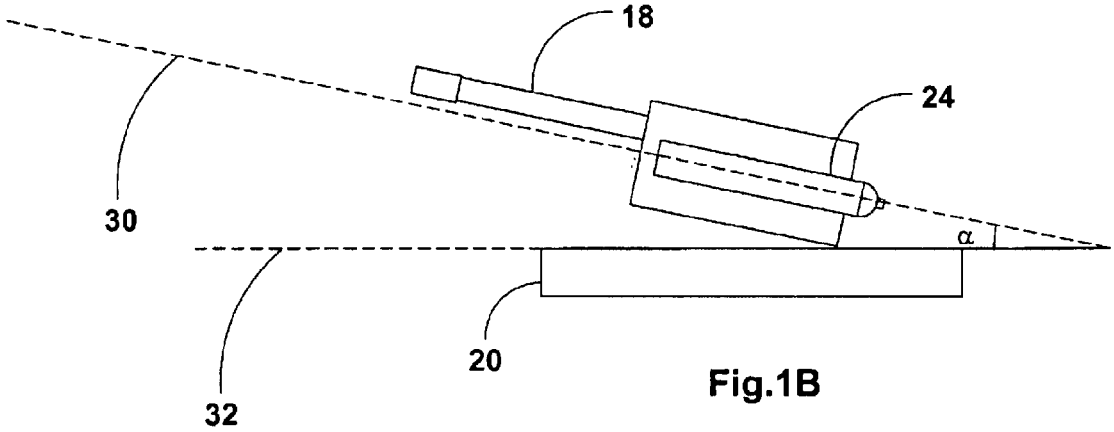
FIG. 1B is a schematic description of a configuration of a gun and a gun-sight directed at a target.
Figure 1C:
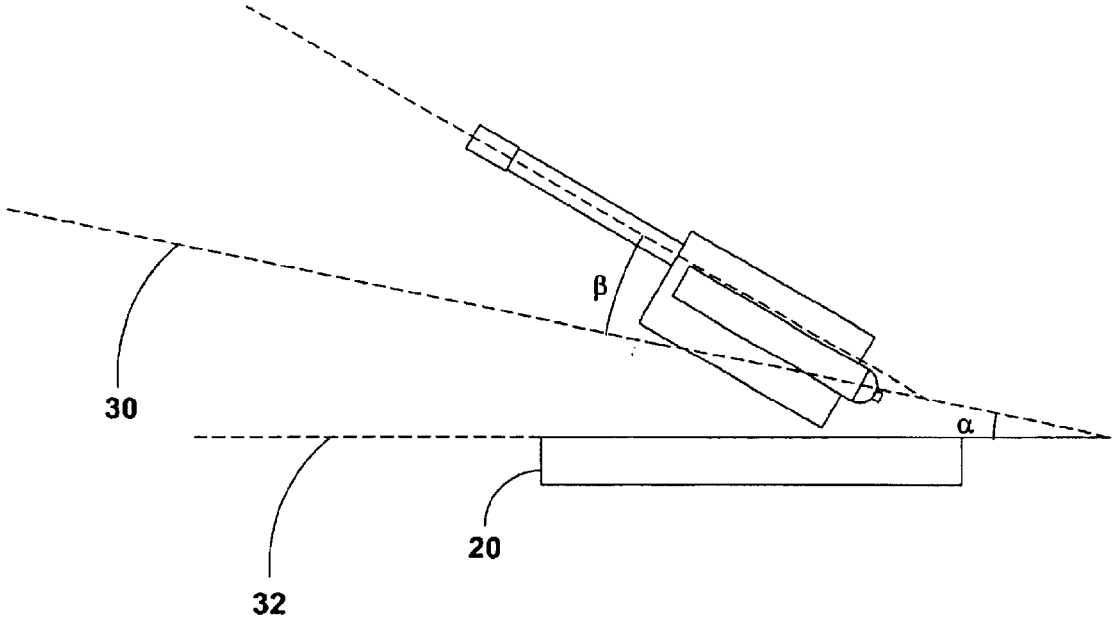
FIG. 1C is a schematic description of a gun elevated by a super-elevation angle.
Figure 2A:
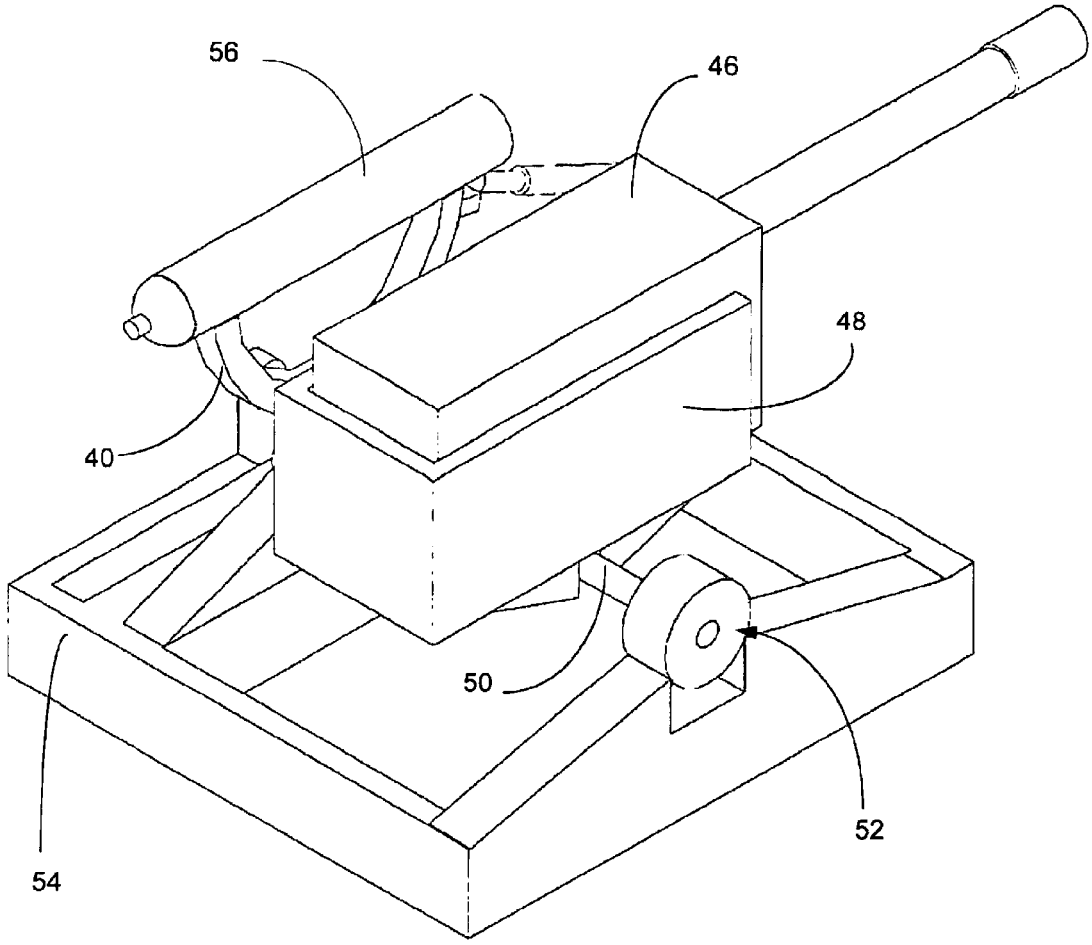
FIG. 2A is a schematic isometric structural description of an embodiment of the invention.
Figure 2B:
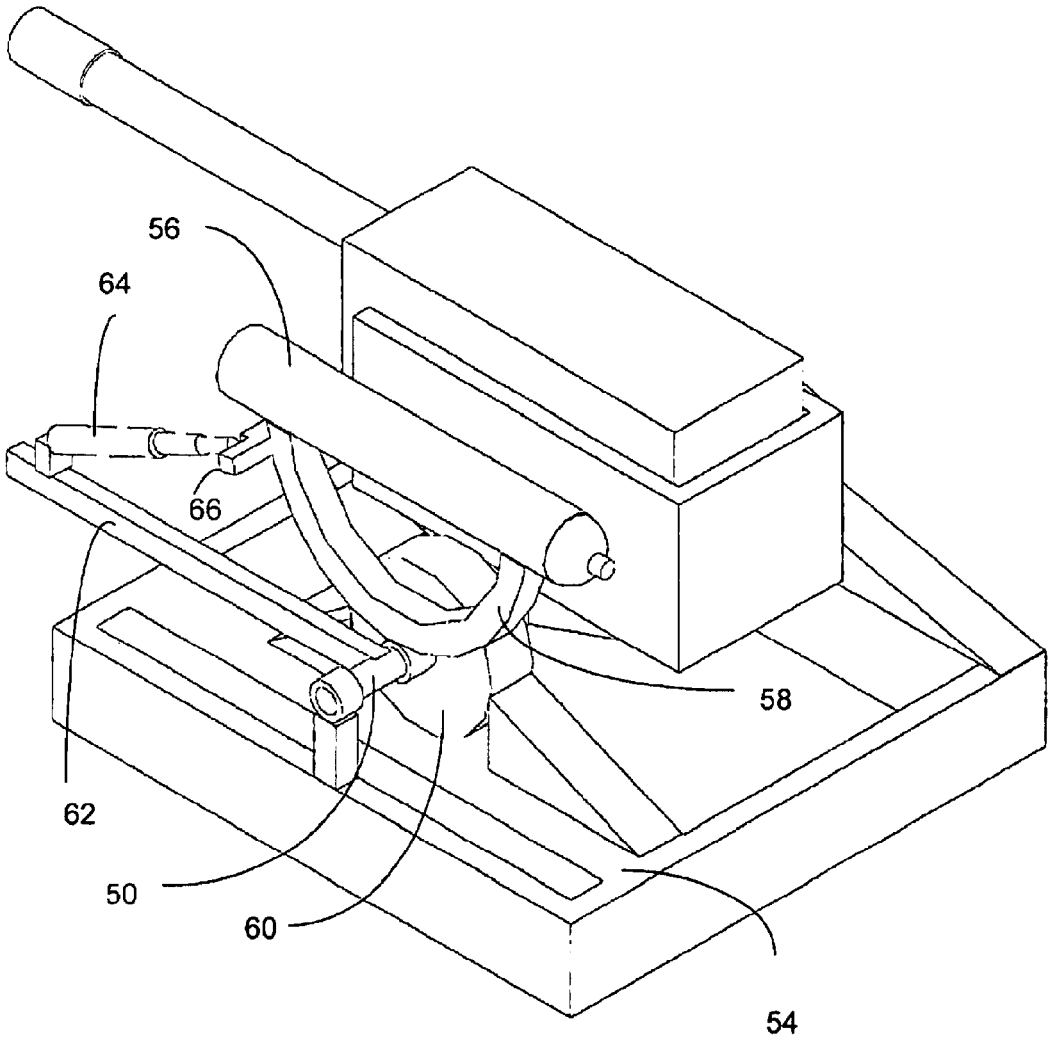
FIG. 2B is a schematic isometric description of an embodiment of the invention as in FIG. 2A at a different viewing angle.

In accordance with the present invention, an automatic grenade launching system uses one electric motor for providing superelevation to a automatic grenade launcher (AGL). The system of the invention includes a compensation mechanism that prevents the elevation angle applied to the AGL from being passed on to the AGL-sight, such that the gunner looking through the sight does not loose contact with the target upon superelevation being provided to the AGL. The system of the invention therefore provides for an enhanced target follow-up capability, assisting the gunner in using a AGL. According to the present invention, a sight of an automatic grenade launcher (AGL), is transiently disengaged from the vertical angular displacement of the AGL in order to allow the gunner to effectively perform target follow-up. To understand the elements of a device of the invention, reference is made to FIG. 2A which is a schematic layout diagram of the system within which the present invention is implemented. AGL 46 is inserted in cradle 48. Main axle 50 provides torque for rotating the AGL-cradle 48 about the horizontal axis. The torque for horizontally rotating AGL-cradle produced by motor 52, which is anchored permanently to system mount 54. In the other side of AGL-cradle 48, is disposed a sight 56. In FIG. 2B the same system is shown at a different isometric view. AGL-sight 56 is mounted on sight-mount 58, which rests through an anti-friction bearing on main axle 50. Brake 60, hereinafter referred to as mount-brake, rigidly attached to system mount 54, is adjacent sight-mount 58. Mount-brake 60 is capable of arresting the vertical angular movement of sight-mount 58 relative to the system-mount 54, by fixing it with respect to the system-mount. Arm 62 is attached to main axle 50, such that it moves angularly with the turning of the axle, keeping a fixed elevation angle with respect to the AGL-cradle 48. Linear lock 64 is pivotally connected at one end to arm 62, and at its other end to a projection 66 of the sight-mount 58.

Figure 3A:
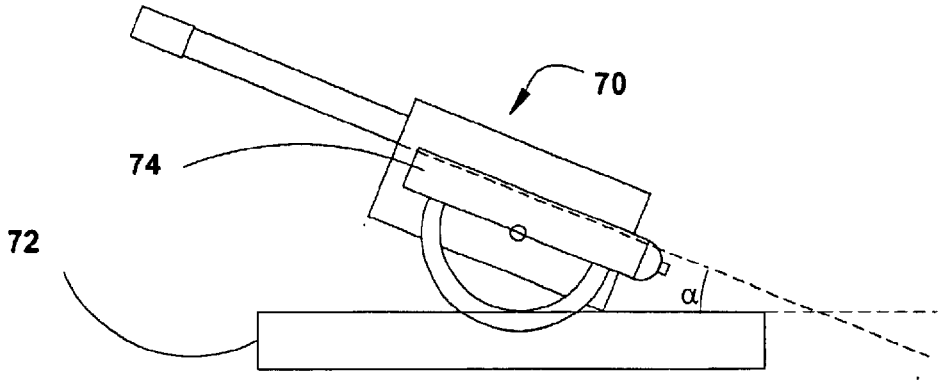
FIG. 3A is a schematic side view of a system of the invention showing automatic grenade launcher (AGL) and sight rotated upwards at the same angle.
Figure 3B:
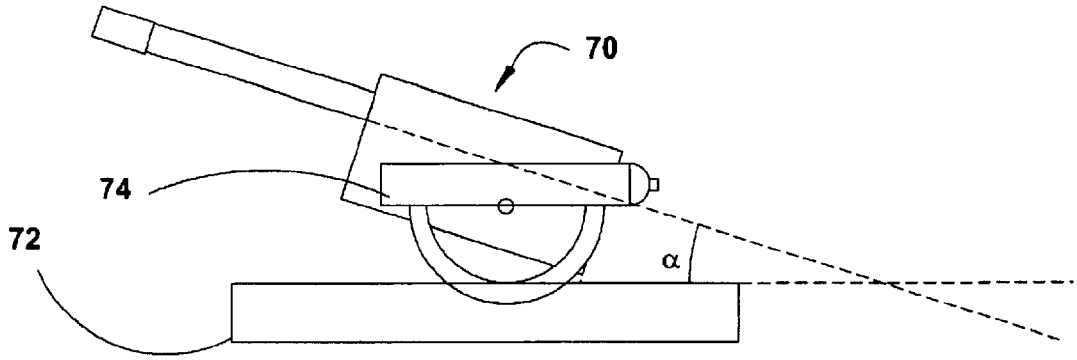
FIG. 3B is a schematic side view of a system of the invention, showing AGL rotated upwards.

In accordance with an embodiment of the invention, a transient disengagement of the AGL-sight from the vertical rotation motion of the AGL is used for keeping a line of sight with the target when the AGL is superelevated. This is described schematically by reference to FIGS. 3A–B. In FIG. 3A, AGL 70 is rotated upwards by an angle α, with respect to the mount 72. The AGL-sight 74, is rotated by the same angle, in the same direction. In FIG. 3B the method of the invention is invoked, letting the AGL rotate upwards with respect to the system mount at angle α, but keeping the sight 74 at a subdued angle.

Figure 4A:
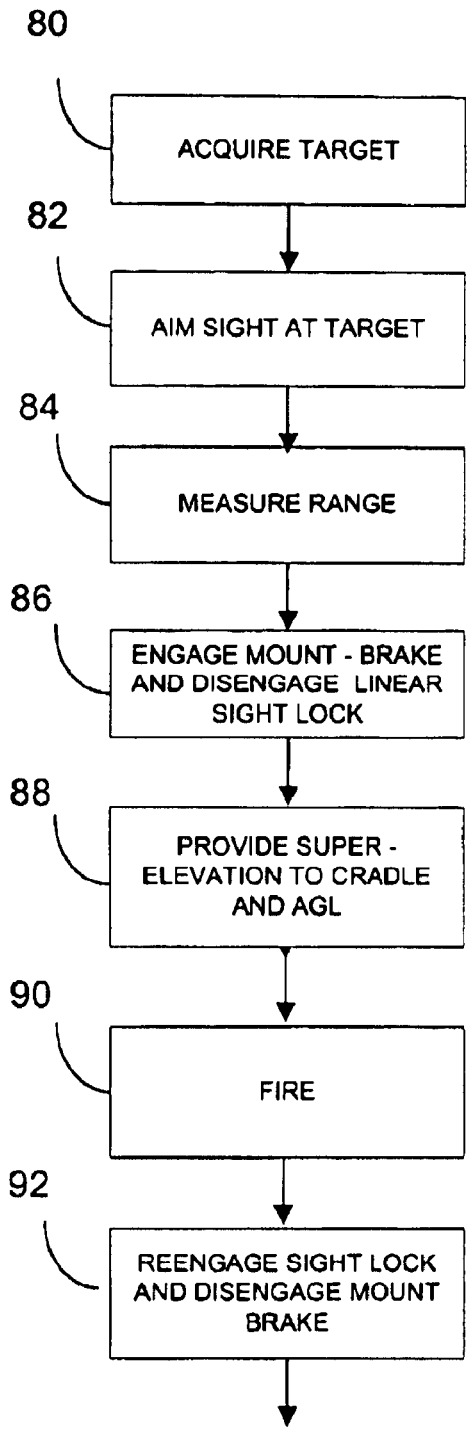
FIG. 4A is a flow chart describing the sequence of steps performed in accordance with the present invention when a target has been acquired.
Figure 4B:
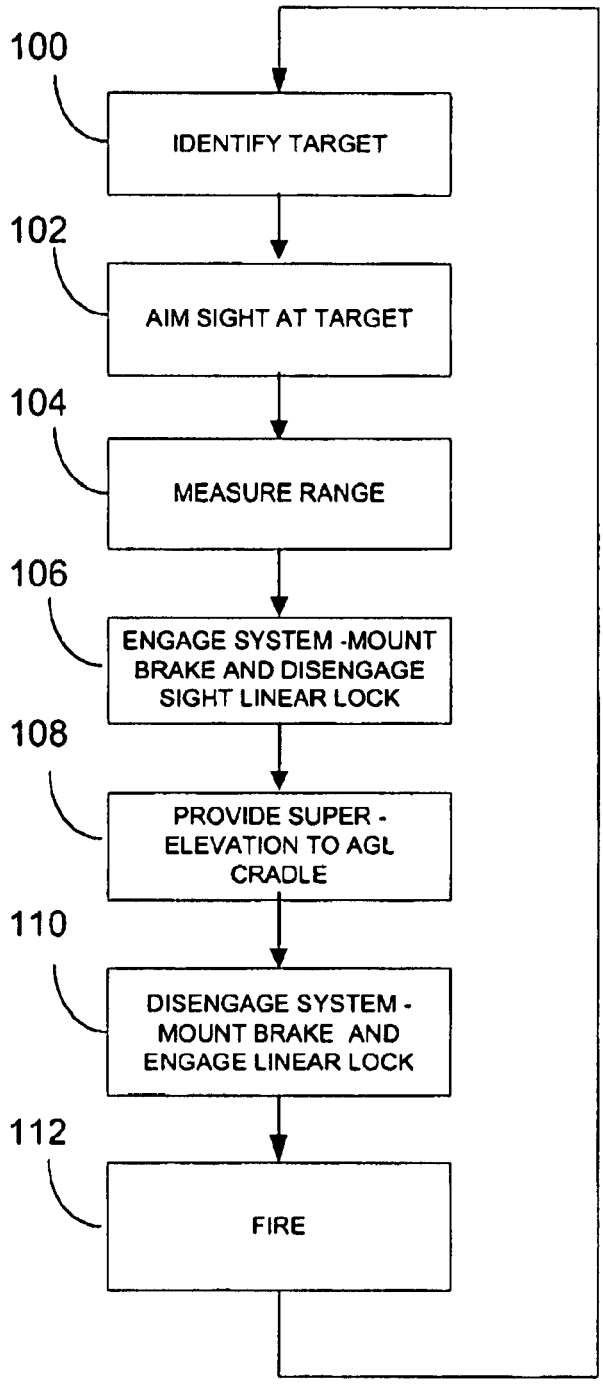
FIG. 4B is a flow chart describing the sequence of steps performed when a recurring target acquisition is performed, in accordance with the invention.

To describe the procedure of the invention, reference is made now to FIGS. 4A–B. In FIG. 4A, as a fresh firing sessions starts, in step 80 a target is acquired, followed by step 82 in which the sight is aimed at the target. In step 84 range to the target is measured, and in step 86 the AGL-sight is fixed with respect to the system-mount by engaging the mount-brake and simultaneously disengaging the linear locking to the main axle. In step 88 super-elevation is provided by the electric motor of the system to the cradle and AGL therein, and in step 90 firing can commence. In step 92 the AGL-sight is re-locked by the linear sight-lock whereas the fixation to the system-mount is released. In other implementations of the invention, re-engagement of the sight-lock and concomitant application of the brake is performed before or during the firing. When a new target is pursued, the procedure follows the outlines portrayed in FIG. 4B to which reference is now made. In step 100 the target is identified, and in step 102 the sight is aimed at the target. In step 104 the range to the target is measured, and in step 106 the AGL-sight is locked to the system mount and the linear locking is disengaged. Then, in step 108, superelevation is provided to the AGL cradle, followed by disengagement of the system-mount brake in step 110. Finally, in step 112 firing is resumed. When firing is finished, and a recurring session is pursued, the procedure begins over again. In a somewhat different embodiment, range-measurement is performed after or simultaneously with the locking of the sight to the system frame.

In a preferred embodiment of the invention, the elevation (or superelevation) of the AGL is kept in registered constantly by the system. This carried out by any known means for electronically measuring an angle between two objects. Typically, a resolver or a potentiometer may be used for measuring the elevation angle of the cradle with respect to the system-mount. Another resolver can be employed concomitantly, to constantly measure the angle between the sight and the system-mount. The difference between the resolvers would then provide the actual angle between the sight and the cradle. In a system using one angle measuring component, typically a resolver is functionally inserted between the sight and the cradle, such that at all times, the angle between the sight and the cradle (and AGL) is known.

Lock and Brake Means Employed In the System of the Invention

To provide a basic alignment of the AGL-sight with the AGL, a linear lock is employed, which transiently fixes the sight-mount to the main axle of the system, thereby practically locking it, transiently, to the AGL-cradle which itself is locked permanently to main axle. Such a locking device is typically a hydraulic lock, that is capable of preventing movement of a piston along its axis. Within such a locking system, compartments filled with oil are hermetically segregated, such that a force applied by the externally powered piston is completely counteracted by the non-compressible oil, and no motion is facilitated. In order to permit movement along the axis, a valve is opened allowing displacement of oil between compartments, as a reaction to an external force applied to the piston. However, the linear transient locking can be applied by different mechanisms. Linear mechanical ratchets, or pneumatic locks are applicable.

The mount-brake, in accordance with the present invention, transiently freezes the angle of the sight with respect to the system-mount. This device is typically a frictional clutch system that can apply a rotational frictional force between juxtaposed bodies. When the mount-brake is engaged, a brake friction element joins by force, such as that of an electro-magnet, and two opposing frictional surfaces, the one attached to the sight-mount and the other attached to the system-mount, have no relative angular movement. To release the frictional brake, which is typically the default state, the electro-magnet is disabled, letting a spring pull the frictional surfaces apart, thereby disengaging the brake.

Operability of a System of the Invention

One gunner is capable of operating an AGL of the invention. The gunner is required to aim at the target, but range measurement can be provided by an external measuring source. The appropriate elevation angle is applied to the AGL, by the gunner activating the electric motor, bringing the sight reticle to the appropriate mark on the target. The range may be measured by the gunner himself, in which case he may also be required to apply the elevation by aligning the reticle mark. An automatic range feed is a possible option, whereby an elevation angle is applied as a function of the range measurement, by way of a controller which activates the motor to the appropriate extent. In all such examples the sight is disconnected from the motor by disengaging the linear lock, and essentially simultaneously having the system-mount brake freeze the vertical angular displacement of the sight with respect to the system-mount. The stability of the sight with respect to the target allows easy orientation of the gunner in the scene and subsequent free application of superelevations without distracting him from the location of the target.

What is claimed is:

1. A system for enhancing target follow-up by a gunner of an automatic grenade launcher (AGL), comprising:

a system-mount;

a AGL cradle;

an axle for vertically rotating said cradle;

an electric motor for providing torque to said axle;

a AGL-sight borne by a sight-mount;

a mount-brake means for freezing the vertical angle of said sight-mount with respect to said system-mount, and a disengageable linear lock for fixing a vertical angular movement of said sight to said AGL cradle.

2. A system for enhancing target follow-up by a gunner of an automatic grenade launcher (AGL) as in claim 1 and wherein said linear lock is an hydraulic lock.

3. A system for enhancing target follow-up by an automatic grenade launcher (AGL) as in claim 1 and wherein said brake means is a frictional clutch.

4. A method for enhancing targets follow-up by a gunner of an automatic grenade launcher (AGL), comprising the steps of:

acquiring a target;

aiming a sight of said AGL at said target wherein said AGL is substantially aligned with said sight;

measuring range to said target and disengaging a linear lock of said sight of said AGL thereby releasing said sight from fixation to a vertical angular displacement of said AGL, and engaging a mount-brake for freezing a vertical angle of said sight relative to said system-mount, and applying an elevation angle to said AGL as a function of the range to said target.

5. A method for enhancing target follow-up by a gunner of an automatic grenade launcher (AGL) as in claim 4, and wherein said elevation angle is applied by a motor to said AGL automatically as a function of said measured range.

* * * * *